United States Patent [19]

Sebestyen

[11] Patent Number: 4,688,797

[45] Date of Patent: Aug. 25, 1987

[54] SYSTEM FOR GENERATING GROUPS OF DIFFERENT NUMBERS

[76] Inventor: Imre Sebestyen, 27 Beech Rd., Islip, N.Y. 11751

[21] Appl. No.: 805,814

[22] Filed: Dec. 6, 1985

[51] Int. Cl.[4] ..... A63F 3/08

[52] U.S. Cl. ..... 273/148 R; 273/138 R; 434/427

[58] Field of Search ..... 273/148 R, 153 R, 138 R; 434/121, 427

[56] References Cited

FOREIGN PATENT DOCUMENTS 1442375 5/1966 France ..... 273/153 R 567307 9/1975 Switzerland ..... 273/148 R

*Primary Examiner*—Anton O. Oechsle

*Attorney, Agent, or Firm*—S. C. Yuter

[57] ABSTRACT

Disclosed is a system for generating six different numbers to bet in a lottery comprising a panel having six openings of the same square shape which is hand held for use with a board having building blocks containing different numbers in square spaces corresponding to the panel openings. When the openings in the panel are placed in alignment and registration with spaces on the board, no matter where on the board the panel is placed, six different numbers are always displayed. This is accomplished by a unique board numbering system and by repeated buidling blocks.

21 Claims, 3 Drawing Figures

BOARD 20
LH22
RH24
BB1
BB4
BB5
BB8
BB9
BB10
BB11
BB14
BB15
BB18
BB19
B2
B3
B6
B7
B10
B13
B16
B17
B20
B12
R1C1
R4C1
R4C12
R4C24
R2C5
R2C9
R8C4
R9C1
R20C8
R20C24

PANEL 10
FRAME 14
r1c1 OPENING
r2c3
16 ARRAY
r4c2
r6c1
r6c3
r8c2
12 HANDLE

SYSTEM FOR GENERATING GROUPS OF DIFFERENT NUMBERS

BACKGROUND OF THE INVENTION

1. Field of the Invention

This invention pertains to systems for generating groups of numbers and, more particularly, to systems for generating groups of different numbers, expecially for use in selecting numbers to play in lotteries.

2. Description of the Related Art

Various devices have been used to generate numbers. However, it is believed that there is a need for a relatively inexpensive, fast and easy way to generate a group of different numbers to play in a lottery.

BRIEF SUMMARY OF THE INVENTION

The principal object of this invention is to provide a relatively inexpensive, fast and easy way to generate a group of different numbers, which is especially useful for selecting different numbers to play in a lottery.

A specific object of this invention is to provide a system for generating six different numbers to play in a lottery.

Briefly, in accordance with the invention, a system for generating a predetermined amount of different numbers to bet in a lottery is provided comprising a panel having openings of the same shape, with the amount of openings the same as the amount of different numbers to be selected. The panel, which is hand held, is used in cooperation with a board having a plurality of adjacent numbers each different from the other and with no number being higher than the highest number allowed to be chosen for a bet. Each of the numbers on the board occupies a space having the same shape as each opening on the panel. The openings in the panel are in a row-column array which corresponds to the row-column array of the board, which has a plurality of building blocks formed in a board pattern which includes many possible row-column arrays corresponding to the row-column array of the panel. When the openings in the panel are placed in alignment with spaces on the board with the plurality of panel openings in registration with the same number of spaces on the board, the predetermined amount of different numbers is displayed for making a bet in a lottery.

An advantage of the invention is that the numbers may be selected with only a single move of the panel.

Other objects, features and advantages of the invention will be apparent from the following detailed description of the preferred embodiment of the invention taken together with the accompanying drawings.

DETAILED DESCRIPTION OF THE PREFERRED EMBODIMENT

Figure 3:
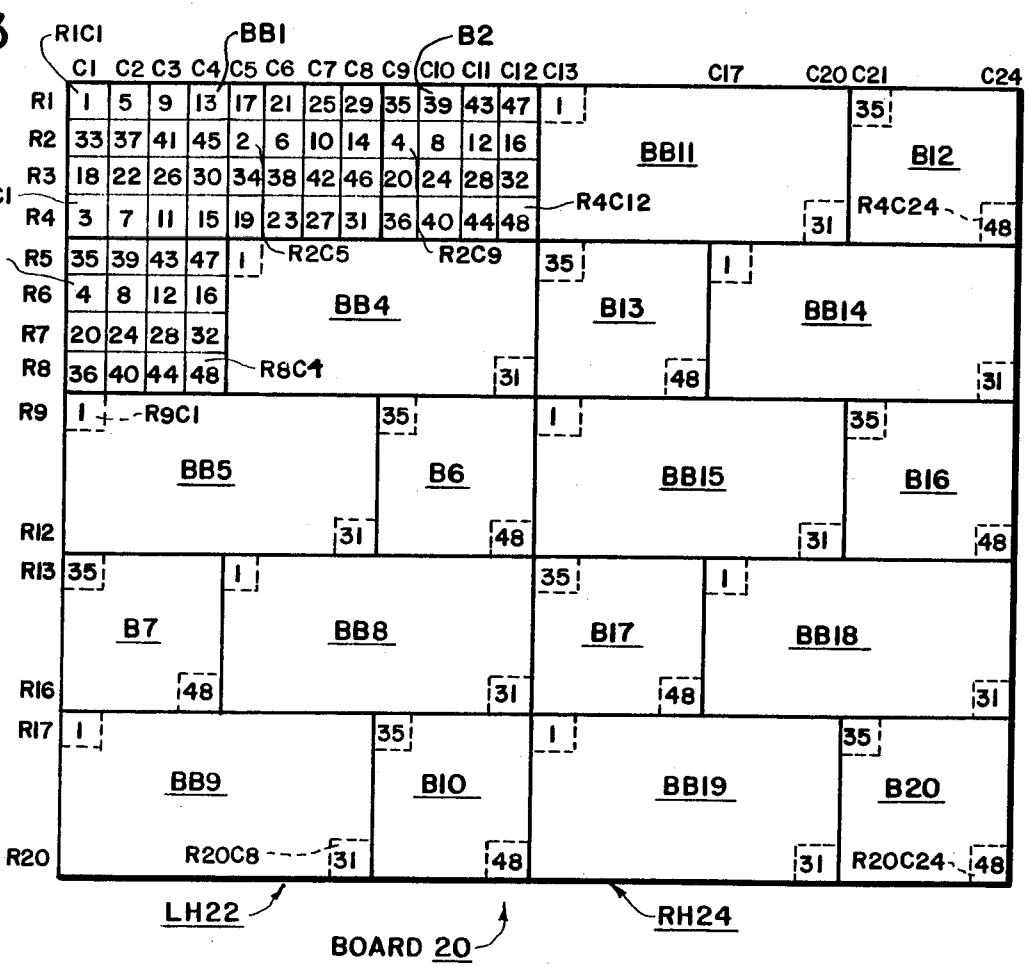
FIG. 3 is a map of the board showing a plurality of building blocks and half building blocks with arrays of different numbers arranged in an overall number pattern so that no matter where the panel is placed on the board, provided the panel openings are in registration with spaces on the board, six different numbers are always displayed.
Figure 1:
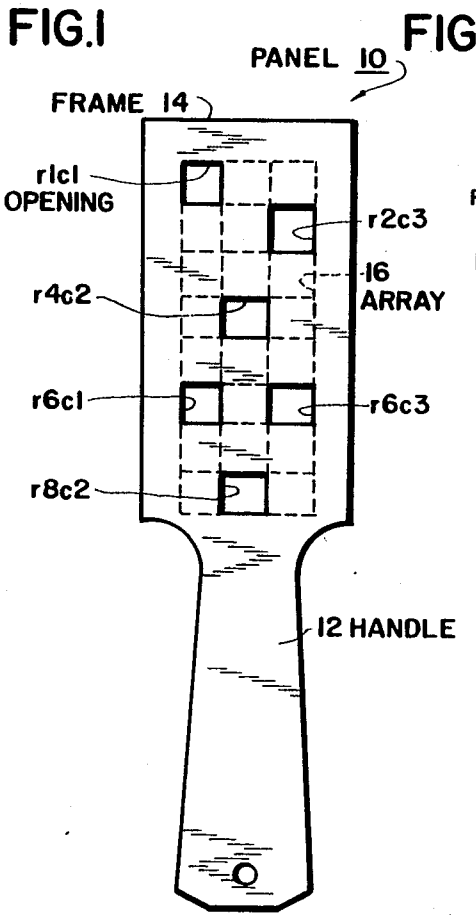
FIG. 1 is a plan view of the hand-held panel with six openings to select six different numbers in accordance with the preferred embodiment of the invention.
Figure 2:
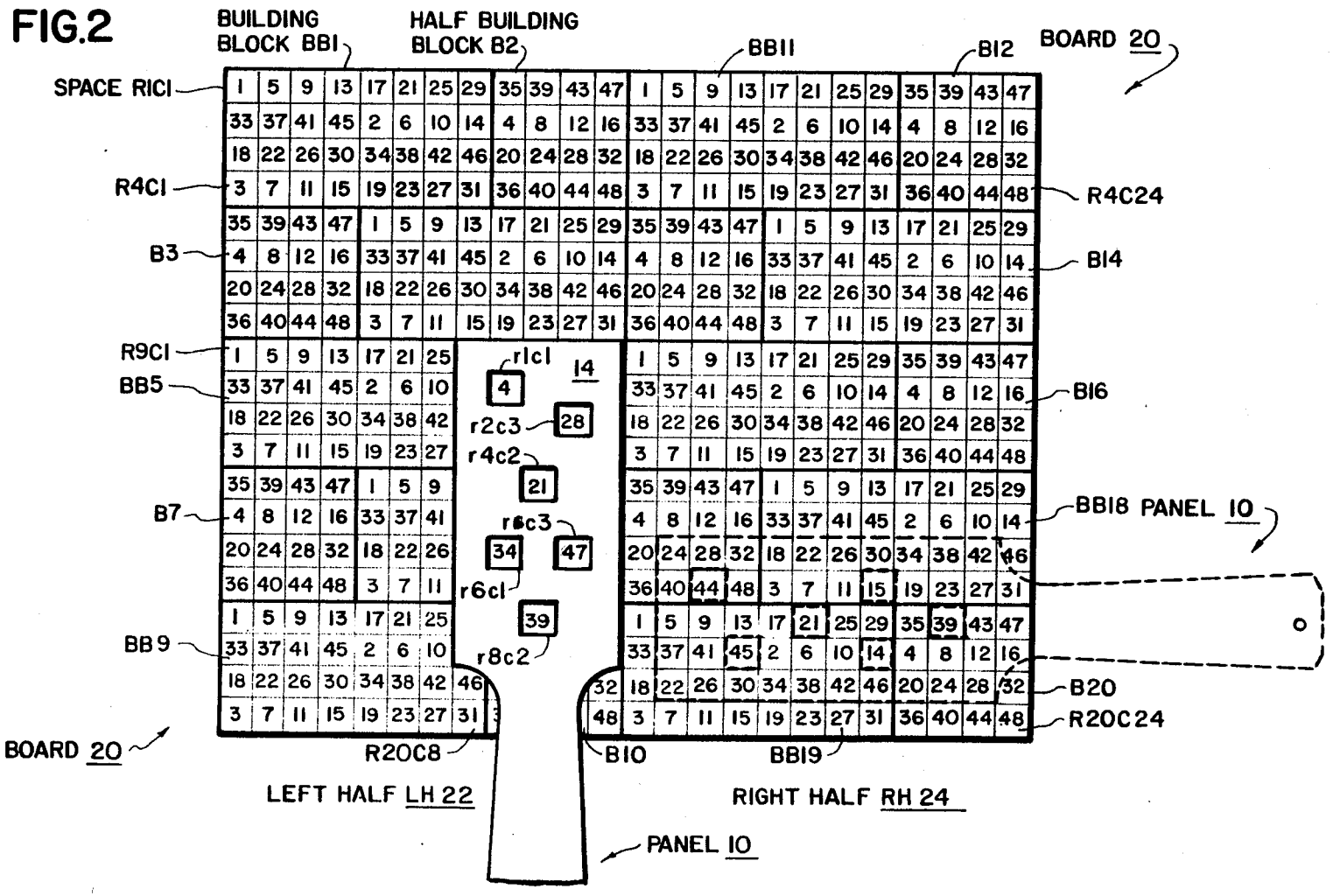
FIG. 2 is a plan view of the board having 48 different numbers and showing the panel positioned over the board to display six different numbers, in accordance with the preferred embodiment of the invention.

FIGS. 1–3 disclose the preferred embodiment of the invention for generating six different numbers in a lottery in which the highest number which can be bet is 48, such as New York State's Lottery LOTTO 48.

Referring to FIG. 1, panel 10 has a handle 12 and frame 14. Frame 14 is divided into a phantom $8\times3$ array 16 (not discernible to the user) of 24 opening positions rc. The 24 opening positions are arranged in six rows and three columns when the panel 10 is viewed in a vertical position. In accordance with the invention, the six openings rc may be randomly selected among the rows and columns of the array 16.

In the illustration of the preferred embodiment of the paddle 10 in FIG. 1, the six openings are designated openings r1c1 (row 1, column 1), r2c3, r4c2, r6c1, r6c3, and r8c2.

The panel 10 is made of plastic and is about $\frac{1}{8}$ inch thick.

In FIG. 2, board 20 consists of a plurality of building blocks BB and half building blocks B arranged in an overall number pattern. Each number on board 20 is in a space RC of a building block BB or B. Thus, the number "1" is in space R1C1 (Row 1, Column 1) in the upper left corner of board 20 and the number "48" is in space R20C24 is the lower right corner of board 20. The number pattern of board 20 is shown in greater detail in FIG. 3, hereinafter referred to.

Panel 10 (FIG. 2) is shown resting on board 20 in a vertical position (at the left) and in an alternate horizontal position (shown in dotted outline on the right). In the vertical position, panel 10's openings rc are in registration with spaces RC on board 20 so that six different numbers are displayed. And a group of six different numbers is also displayed by panel 10 when placed on the board in the horizontal position at the right. In fact, as long as panel 10 is placed in orthogonal relation with board 20 (that is, at right angles), no matter where, as long as the openings rc are in registration with the spaces RC, six different numbers will be displayed.

More particularly, the $8\times3$ array 16 of 24 opening positions of panel 10 consists of eight rows and three columns so that, on board 20, every number in a corresponding space array of eight rows and three columns is different. How the invention achieves that result is best illustrated in FIG. 3.

Referring to building block BB1 in the upper left corner of board 20, it comprises four rows R of eight columns C for a total of 32 spaces in building block BB1. Starting with space R1C1 with the number "1", each adjacent space RC to the right has a number which is four higher than the next preceding number. Thus space R1C1 has number "1", space R1C2 has number "5", space R1C3 has number "9", space R1C4 has number "13", space R1C5 has number "17", space R1C6 has number "21", space R1C7 has number "25" and space R1C8 has number "29", which is at the right end of the building block BB1. The numbers in building block BB1 then continue in the next row down with space R2C1 having the number "33" and space R2C4 the number "45". At this point, the addition of four to "45" would produce "49" which exceeds the highest allowable number "48", so the sequence then reverts to "2" in space R2C5 and the incrementing by four continues to "14" in space R2C8, "18" in space R3C1 and, sequentially, to "46" in space R3C8 of building block BB1. Adding four to "46" exceeds the highest allowable number "48" so that, at space R4C1 the sequence starts again but this time with the number "3" and ends with number "31" in space R4C8.

Thus in building block BB1 there are 32 different numbers with none exceeding "48" and with 16 numbers in the total allowable 48 numbers missing. These 16 different numbers appear in the half building block B2 to the right of building block BB1 and, in the same pattern, beneath building block BB1 in half building block B3. Note that if the panel 10 orthogonally overlays either building blocks BB1 and B2 or building blocks BB1 and B3 (it cannot overlay both of the half building blocks B2 and B3), no matter where, six different numbers of the sequence of available numbers "1" through "48" will always be displayed. And that is so irrespective where in the opening position array 16 of panel 10 the openings rc are placed.

Note that building block BB1 at space R4C8 ends in the number "31". That provides the base for the beginning number in half building block B2. That is, adding four to "31" gives "35", the first number at space R1C9 in half building block B2. Then, adding four to the preceding number, gives "39" in space R1C10, "43" in space R1C11 and "47" in space R1C12. Since adding four to "47" will exceed the highest allowable number "48", a new sequence is originated starting with "4" in space R2C9 in building block B2. This new sequence follows the sequence in building block BB1 beginning with "3" in space R4C1. Then, in building block B2, the sequence continues with "8" in space R2C10, "12" in space R2C11 to "48" in space R4C12.

Thus, in building blocks BB1 and B2 all of the 48 allowed numbers are present in the 32 spaces of building block BB1 and the 16 spaces in building block B2.

Now theoretically, only building blocks BB1, B2 and B3 are necessary in order to generate six different numbers to be bet in a lottery with the highest permitted number being "48". But, in accordance with the invention, a much larger diversity of panel 10 positions is provided for by repeating the basic building block pattern BB1, B2 and B3 vertically in the left half LH22 of board 20. And then the positions are doubled again by duplicating left half LH22 on the right half of board 20 in right half RH24. This very great diversity of panel 10 positions adds to the fun of selecting six different numbers to be bet in a lottery or any other game.

Specifically, the building block pattern BB1, B2 and B3 is repeated beneath half building block B3 with building block BB5, half building block B6 and half building block B7 on the left half LH22 of board 20. Then the pattern is ended beneath half building block B7 with the building block BB9 and half building block B10. Of course, this procedure could be extended vertically downward or horizontally sideward if a larger board 20 is desired.

But to increase the diversity of panel 10 positions even more, the full building block BB1 is duplicated to the right of half building block B3 by building block BB4, and to the right of half building block B7 by building block BB8.

While the spaces RC on board 20 are in the shape of squares, other shapes can be used such as circles, trapezoids, and rectangles.

While the numbers in a building block BB1 or B2 are produced by adding four to the preceding number in the building block, the numbers in a building block may be completely random providing there is no duplication of numbers in building blocks BB1 and B2.

Finally, by turning panel 10 over before placing it on board 20, a different group of numbers is displayed because the openings rc in panel 10 are then in a different pattern in the array 16, as shown in dotted outline at the lower right of FIG. 2. The dotted outline shows panel 10 after it has been rotated about an axis extending along its major dimension and also rotated about an axis perpendicular to the first axis.

In sum, the invention provides a relatively inexpensive, fast and easy way to generate a group of different numbers, which is especially useful for selecting different numbers to play in a lottery. Moreover, the different numbers are generated with a single move of placing panel 10 in registration with spaces RC on the board 20.

What is claimed is:

1. A system for generating a predetermined amount of different numbers to bet in a game comprising:

(A) A panel rotatable about an axis extending along a major dimension thereof and about an axis perpendicular to said major dimension axis, said panel having openings of the same shape in a predetermined orthogonally-spaced pattern, with one opening for each of said predetermined amount of numbers to be selected for a bet;

(B) A board separate from and unattached to said panel having a plurality of adjacent numbers arranged in vertically and horizontally displaced building blocks, with the numbers in each building block being different from each other and with no number in a building block being higher than the highest number allowed to be chosen for a bet;

(C) Each of said numbers on said board occupying a space having a shape substantially the same as the shape of each opening in said panel;

(D) Each of the spaces in a building block being in an orthogonal pattern of rows and columns corresponding to the orthogonal pattern of the openings in said panel;

(E) Whereby, when the openings in said panel by relative vertical, horizontal or rotational movement of said panel with respect to said board are placed in orthogonal alignment with rows and columns of spaces on said board and with the plurality of openings in said panel being in registration with an equal number of spaces on said board, said predetermined amount of different numbers are displayed for making a bet in a game.

2. A system for generating a predetermined amount of different numbers to bet in a game according to claim 1 wherein the openings in said panel are in the shape of squares and each of said numbers on said board occupies a square.

3. A system for generating a predetermined amount of different numbers to bet in a game according to claim 1 wherein said amount of numbers is six.

4. A system for generating a predetermined amount of different numbers to bet in a game according to claim 1 wherein each one of the plurality of adjacent numbers arranged in a building block differs from a preceding one by the sum of four.

5. A system for generating a predetermined amount of different numbers to bet in a game according to claim 4 wherein said predetermined amount of different numbers in a game is 48 and the highest number allowed to be chosen for a bet is 48.

6. A system for generating a predetermined amount of different numbers to bet in a game comprising:

(A) A panel having openings of the same shape in a predetermined orthogonally-spaced pattern, with one opening for each of said predetermined amount of numbers to be selected for a bet;

(B) A board having a plurality of adjacent numbers arranged in building blocks, with the numbers in each building block being different from each other and with no number in a building block being higher than the highest number allowed to be chosen for a bet;

(C) Each of said numbers on said board occupying a space having a shape substantially the same as the shape of each opening in said panel;

(D) Each of the spaces in a building block being in an orthogonal pattern of rows and columns corresponding to the orthogonal pattern of the openings in said panel;

(E) Each one of a plurality of adjacent numbers arranged in a building block differing from a preceding one by the sum of four;

(F) Each of said predetermined amount of different numbers in a game being 48 and the highest number allowed to be chosen for a bet being 48;

(G) There being full building blocks and half building blocks and each full building block comprises 32 numbers and each half building block comprises 16 numbers;

(H) Whereby, when the openings in said panel are placed in orthogonal alignment with rows and columns of spaces on said board and with the plurality of openings in said panel being in registration with an equal number of spaces on said board, said predetermined amount of different numbers are displayed for making a bet in a game.

7. A system for generating a predetermined amount of different numbers to bet in a game according to claim 6 wherein said board is divided into a left half and a right half with each half having a width of 12 numbers.

8. A system for generarating a predetermined amount of different numbers to be bet in a game according to claim 7 wherein each half of said board comprises a full building block and a half building block across said half of said board.

9. A system for generating a predetermined amount of different numbers to be bet in a game according to claim 8 wherein on each half of said board from the top of said half to the bottom of said half full building blocks and half building blocks alternate sequentially.

10. A system for generating a predetermined amount of different numbers to be bet in a game according to claim 6 wherein each of said full building blocks on said board has the same number pattern and each of said half building blocks on said board has the same number pattern.

11. A system for generating a predetermined amount of different numbers to bet in a game comprising:

(A) A panel rotatable about an axis extending along a major dimension thereof and about an axis perpendicular to said major dimension axis, said panel having openings of the same shape in a predetermined pattern, with one opening for each of said predetermined amount of numbers to be selected for a bet;

(B) A board separate from and unattached to said panel having a plurality of adjacent numbers arranged in vertically and horizontally displaced building blocks, with the numbers in each building block being different from each other and with no number in a building block being higher than the highest number allowed to be chosen for a bet;

(C) Each of said numbers on said board occupying a space having a shape corresponding to the shape of each opening in said panel;

(D) Each of the spaces in a building block being in a pattern corresponding to the pattern of the openings in said panel;

(E) Whereby, when the openings in said panel are placed by relative vertical, horizontal or rotational movement of said panel with respect to said board in alignment with spaces on said board and with the plurality of openings in said panel being in registration with an equal number of spaces on said board, said predetermined amount of different numbers are displayed for making a bet in a game.

12. A system for generating a predetermined amount of different numbers to bet in a game according to claim 11 wherein each one of the plurality of adjacent numbers arranged in a building block differs from a preceding one by a given amount.

13. A system for generating a predetermined amount of different numbers to bet in a game comprising:

(A) A panel having openings of the same shape in a predetermined pattern, with one opening for each of said predetermined amount of numbers to be selected for a bet;

(B) A board having a plurality of adjacent numbers arranged in building blocks, with the numbers in each building block being different from each other and with no number in a building block being higher than the highest number allowed to be chosen for a bet;

(C) Each of said numbers on said board occupying a space having a shape corresponding to the shape of each opening in said panel;

(D) Each of the spaces in a building block being in a pattern corresponding to the pattern of the openings in said panel;

(E) There being full building blocks and half building blocks and each full building block comprises a second predetermined amount of numbers and each half building block comprises one half of said second predetermined amount of numbers;

(F) Whereby, when the openings in said panel are placed in alignment with spaces on said board and with the plurality of openings in said panel being in registration with an equal number of spaces on said board, said predetermined amount of different numbers are displayed for making a bet in a game.

14. A system for generating a predetermined amount of different numbers to bet in a game according to claim 13 wherein said board is divided into two halves with each half having a dimension equal to a third predetermined amount of numbers.

15. A system for generating a predetermined amount of different numbers to bet in a game according to claim 12 wherein each of said full building blocks has the same number pattern.

16. A system for generating a predetermined amount of different numbers to bet in a game according to claim 15 wherein each of said half building blocks has the same number pattern.

17. A system for generating a predetermined amount of different numbers to bet in a game according to claim 1 wherein the openings in said panel are in the shape of rectangles and the space of each of said numbers on said board is a rectangle of substantially the same size as each of the rectangles in said panel.

18. A system for generating a predetermined amount of different numbers to bet in a game according to claim 1 wherein each plurality of adjacent numbers in a building block differs from a preceding one by a given amount.

19. A system for generating a predetermined amount of different numbers to bet in a game according to claim 18 wherein each building block has the same pattern of numbers.

20. A system for generating a predetermined amount of different numbers to bet in a game comprising:

(A) A panel having openings of the same shape in a predetermined orthogonally-spaced pattern, with one opening for each of said predetermined amount of numbers to be selected for a bet;

(B) A board having a plurality of adjacent numbers arranged in building blocks, with the numbers in each building block being different from each other and with no number in a building block being higher than the highest number allowed to be chosen for a bet;

(C) Each of said numbers on said board occupying a space having a shape substantially the same as the shape of each opening in said panel;

(D) Each of the spaces in a building block being in an orthogonal pattern of rows and columns corresponding to the orthogonal pattern of the openings in said panel;

(E) Each one of a plurality of adjacent numbers arranged in a building block differing from a preceding one by a given amount;

(F) There being full building blocks and half building blocks and each of said full building blocks has the same pattern of numbers and each of said half building blocks has the same pattern of numbers which are different from the pattern of numbers of said full building blocks;

(G) Whereby, when the openings in said panel are placed in orthogonal alignment with rows and columns of spaces on said board and with the plurality of openings in said panel being in registration with an equal number of spaces on said board, said predetermined amount of different numbers are displayed for making a bet in a game.

21. A system for generating a predetermined amount of different numbers to bet in a game according to claim 11 wherein said rotatable panel has asymetric openings so that when it is rotated about its axis over exactly the same given area of said board a different group of numbers is displayed.

* * * * *